US006095264A

United States Patent [19]

Dillard

[11] Patent Number: 6,095,264

[45] Date of Patent: Aug. 1, 2000

[54] ROLLING CUTTER DRILL BIT WITH STABILIZED INSERT HOLES AND METHOD FOR MAKING A ROLLING CUTTER DRILL BIT WITH STABILIZED INSERT HOLES

[75] Inventor: Walter S. Dillard, Pasadena, Tex.

[73] Assignee: Camco International, Inc., Houston, Tex.

[21] Appl. No.: 09/234,854

[22] Filed: Jan. 22, 1999

[51] Int. Cl.[7] ..... E21B 10/16

[52] U.S. Cl. ..... 175/331; 175/432

[58] Field of Search ..... 175/331, 432, 175/338

[56] References Cited

U.S. PATENT DOCUMENTS 4,096,917 6/1978 Harris .
4,610,317 9/1986 England et al. .
4,796,713 1/1989 Bechem et al. .
5,027,913 7/1991 Nguyen .
5,547,033 8/1996 Campos, Jr. ..... 175/331
5,588,497 12/1996 Thorburn .
5,636,700 6/1997 Shamburger, Jr. ..... 175/331
5,697,461 12/1997 Newton et al. ..... 175/331
5,755,297 5/1998 Young et al. ..... 175/331
5,755,301 5/1998 Love et al. .
5,868,213 2/1999 Cisneros et al. ..... 175/331

*Primary Examiner*—Robert E. Pezzuto
*Attorney, Agent, or Firm*—Tobor, Goldstein & Healey, L.L.P.

[57] ABSTRACT

A rolling cutter drill bit and method for making a rolling cutter drill bit having a cutting insert pressed into a socket, wherein the socket forms a juncture with the curved outer surface of a rolling cutter, and the juncture contacts a plane in contact with the juncture in at least three points located on the juncture.

14 Claims, 7 Drawing Sheets

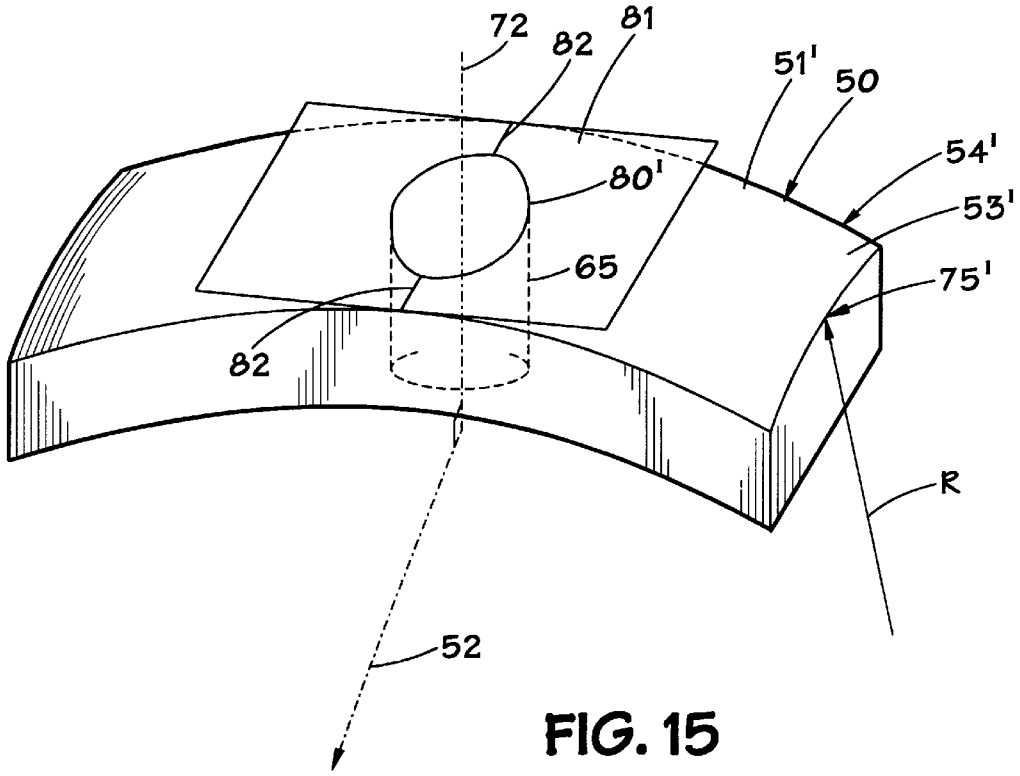
FIG. 15
FIG. 16
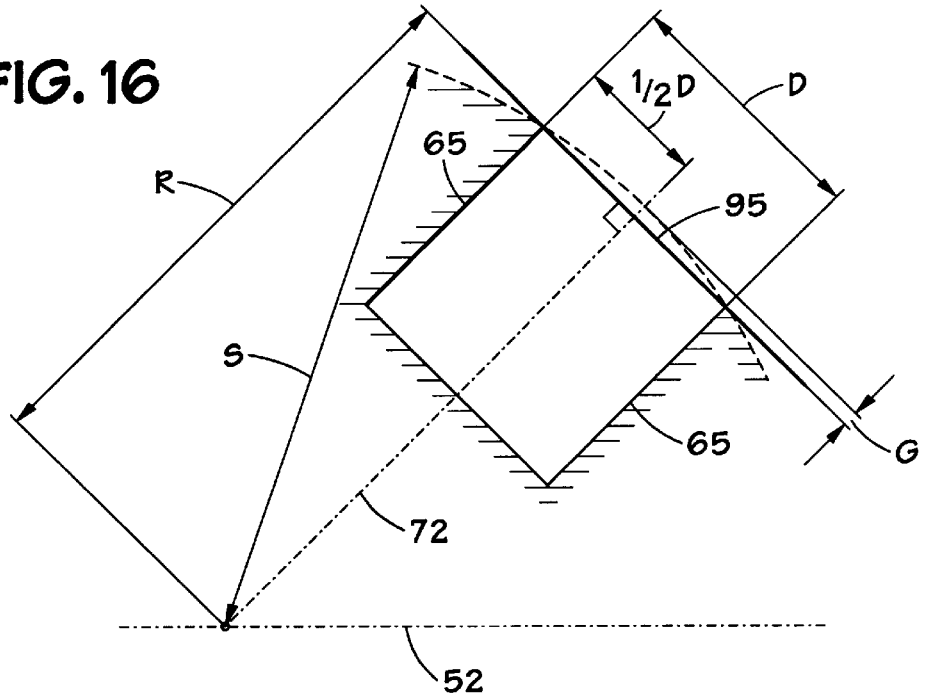

ROLLING CUTTER DRILL BIT WITH STABILIZED INSERT HOLES AND METHOD FOR MAKING A ROLLING CUTTER DRILL BIT WITH STABILIZED INSERT HOLES

BACKGROUND OF THE INVENTION

1. Field of the Invention

The present invention relates to the art of earth boring with rolling cutter drill bits. In particular, the present invention relates to a design of, and a method for making, a rolling cutter drill bit to provide for better retention of cutting inserts disposed in the rolling cutter of the drill bit.

2. Description of Related Art

Rolling cutter drill bits have cutting teeth on the rolling cutter to crush and penetrate the rock being drilled. There are two basic types of rolling cutter drill bits. The first type has steel teeth formed on the rolling cutter. These teeth usually have a layer of hard wear, resistant material to resist the abrasive action of the rock.

The second type of rolling cutter drill bit has steel rolling cutters with a number of protruding tungsten carbide cutting inserts. Machined upon each cutter are one or more conic segments with different conic angles. These segments form bands, or conic bands, which are concentric with the longitudinal axis of the cutter. The cutting inserts typically have a generally cylindrical shape and a generally circular cross-sectional configuration. The cutting inserts are received by sockets, or insert holes, drilled into the rolling cutter, perpendicular to the surface of the conic band, or conic segments. A plurality of insert holes drilled along the same radius of a band to form a row of insert holes on that band. The cutting inserts are held in place in the sockets by an interference fit. Although the bands are curved, when viewed in a cross-section parallel to the axis of the cutter, the upper surfaces of the bands are flat. For clarity in understanding the present invention, the flat cross-section of the band upper surface is defined as the axial surface of the band.

To provide an interference fit between the cutting insert and the socket, the socket is formed with a diameter slightly smaller than that of the cylindrical body of the cutting insert. The cutting insert is then pressed into the socket and retained by the contact force between the socket wall and the outer wall surface of the cylindrical body of the cutting insert. Because the insert diameter exceeds that of the socket and because of the hardness of the cutting insert material, the installation procedure can be difficult and can damage the socket. A damaged socket can reduce the contact force between the cutting insert and the socket wall. If the socket becomes sufficiently damaged during installation, the cutting insert can dislodge from the socket during drilling operations. Additionally, a damaged socket can also allow the cutting insert to rotate in the socket during drilling, which can decrease the cutting effectiveness of the cutting insert. Traditional approaches to solve the foregoing problems have generally included modifying the shape of the cutting insert and/or modifying the shape and taper of the socket.

Since the conic band on the cutter is curved, the insert can move out of axial alignment with the insert hole as it is being pressed into the insert hole. One possible technique to prevent this mis-alignment is to spotface a flat area on the surface of the cutter around each insert hole, or socket, with a milling machine. The juncture of the outer surface of the cutter and the insert hole will then form a plane, which will fully contact the periphery of the bottom of the insert. This full contact could help to minimize mis-alignment of the insert with respect to the insert hole during pressing.

The process of spotfacing the curved surface around each insert hole is not only time consuming and expensive, but this process may also leave sharp edge surfaces that can become sites for undesired crack formation. Consequently, the integrity of the insert press fit may often be less than ideal. A poor press fit can cause an insert to loosen in operation and fall out of the insert socket, or insert hole, of the cutter.

Accordingly, prior to the development of the present invention, there has been no rolling cutter drill bit with stabilized insert holes or method for making a rolling cutter drill bit with stabilized insert holes, which: routinely and consistently permit cutting inserts to be pressed into the rolling cutter without misalignment problems; prevent the cutting inserts from prematurely being loosened and removed from their sockets; prevent the cutting inserts from rotating within their sockets; and are efficiently and inexpensively utilized. Therefore, the art has sought a rolling cutter drill bit with stabilized insert holes and a method for making a rolling cutter drill bit with stabilized insert holes which: routinely and consistently permits cutting inserts to be pressed into their sockets without misalignment problems; prevent the cutting inserts from prematurely loosening within their sockets and falling out of the sockets; prevent the cutting inserts from rotating within their sockets; and are efficient and economical to manufacture and use.

SUMMARY OF INVENTION

In accordance with the invention, the foregoing advantages have been achieved with the present rolling cutter drill bit. The present invention includes: a body; at least one leg; a bearing spindle formed on the at least one leg; a rolling cutter, having an outer surface, rotatably mounted upon the bearing spindle; at least one conic band disposed upon the outer surface of the rolling cutter; at least one socket formed in the at least one conic band; at least one cutting insert received within the at least one socket, the at least one cutting insert having an outer wall surface and a bottom surface, the bottom surface having a periphery, the outer surface of the at least one cutting insert being received within the at least one socket with an interference fit; and the at least one socket forming a juncture with the at least one conic band, the juncture contacting a plane in contact with the juncture in at least three points located on the juncture.

A further feature of the present invention is that when the at least one cutting insert is first inserted into the at least one socket, the periphery of the bottom surface of the at least one cutting insert contacts the juncture of the at least one socket in at least three points located on the juncture. Another feature of the present invention is that the conic band may have a spherically shaped axial surface. An additional feature of the present invention is that the at least one conic band may have a convex shaped axial surface. A further feature of the present invention is that the at least one conic band may have an axial surface, and further includes an upwardly extending ridge disposed upon the axial surface, with the juncture, of the at least one socket with the at least one conic band, including at least one portion of the upwardly extending ridge.

In accordance with the invention, the foregoing advantages have also been achieved through the present method for making a rolling cutter drill bit, which includes at least one rotatably mounted rolling cutter having an outer surface, and at least one conic band disposed upon the outer surface of the rolling cutter. The method of the present invention may comprise the steps of: forming at least one socket in the at least one conic band of the rolling cutter, the at least one socket forming a juncture with the at least one conic band; providing at least one cutting insert having an outer wall surface and a bottom surface, the bottom surface having a periphery, the at least one cutting insert being sized to be received within the at least one socket with an interference fit; inserting the at least one cutting insert into the at least one socket by first bringing the periphery of the bottom surface of the cutting insert into contact with at least three points located on the juncture to stabilize the at least one cutting insert with respect to the at least one socket; and thereafter pressing the at least one cutting insert into the at least one socket, until the at least one cutting insert is retained in the at least one socket by an interference fit.

A further feature of this aspect of the present invention is that the at least one conic band has an axial surface, and includes the step of providing the axial surface with a spherical shape. Another feature of the present invention is that the at least one conic band has an axial surface, including the step of providing the axial surface with a convex shape. A additional feature of the present invention is that the at least one conic band may have an axial surface, including the step of providing an upwardly extending ridge upon the axial surface with the juncture, of the at least one socket with the at least one conic band, including at least one portion of the upwardly extending ridge.

The rolling cutter drill bit and method for making a rolling cutter drill bit of the present invention, when compared with previously proposed prior art rolling cutter drill bits and methods for making them, have the advantages of: routinely and consistently permitting the cutting inserts to be pressed into their sockets with a secure interference fit without misalignment problems; prevent damage to the socket by stabilizing the cutting inserts prior to its being pressed into the socket; prevents the cutting inserts from prematurely being loosened within the socket and falling out of the socket; prevents the cutting inserts from rotating within their sockets; and are efficiently and inexpensively made and used.

BRIEF DESCRIPTION OF THE DRAWING

In the drawing:

FIG. 15 is a perspective view of a portion of a rolling cutter in accordance with another embodiment of the present invention;

FIG. 16 is an exploded view of a portion of the rolling cutter of FIG. 3, illustrating the geometric relationships of certain aspects of the present invention.

While the invention will be described in connection with the preferred embodiments, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION AND SPECIFIC EMBODIMENTS

Figure 1:
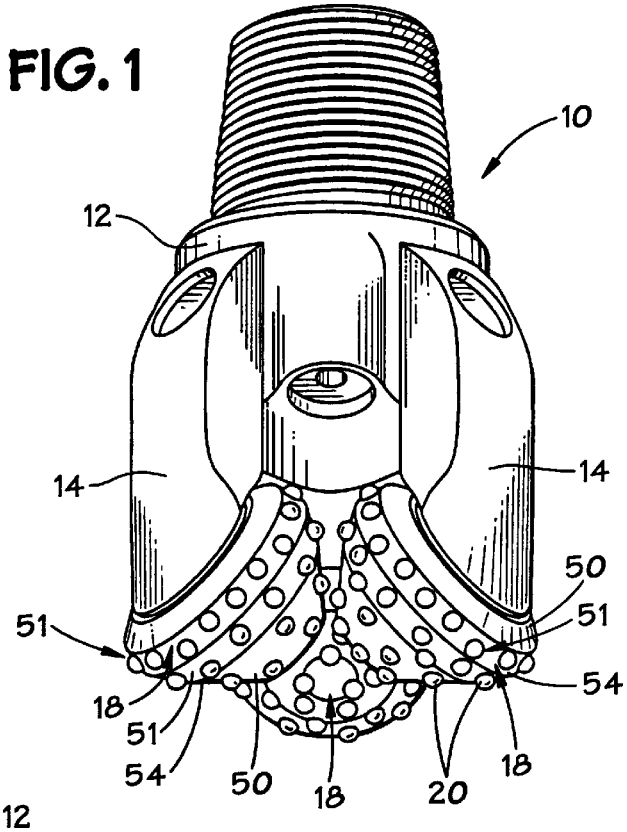
FIG. 1 is a perspective view of a rolling cutter drill bit which may be provided with the stabilized cutting insert holes of the present invention.
Figure 2:
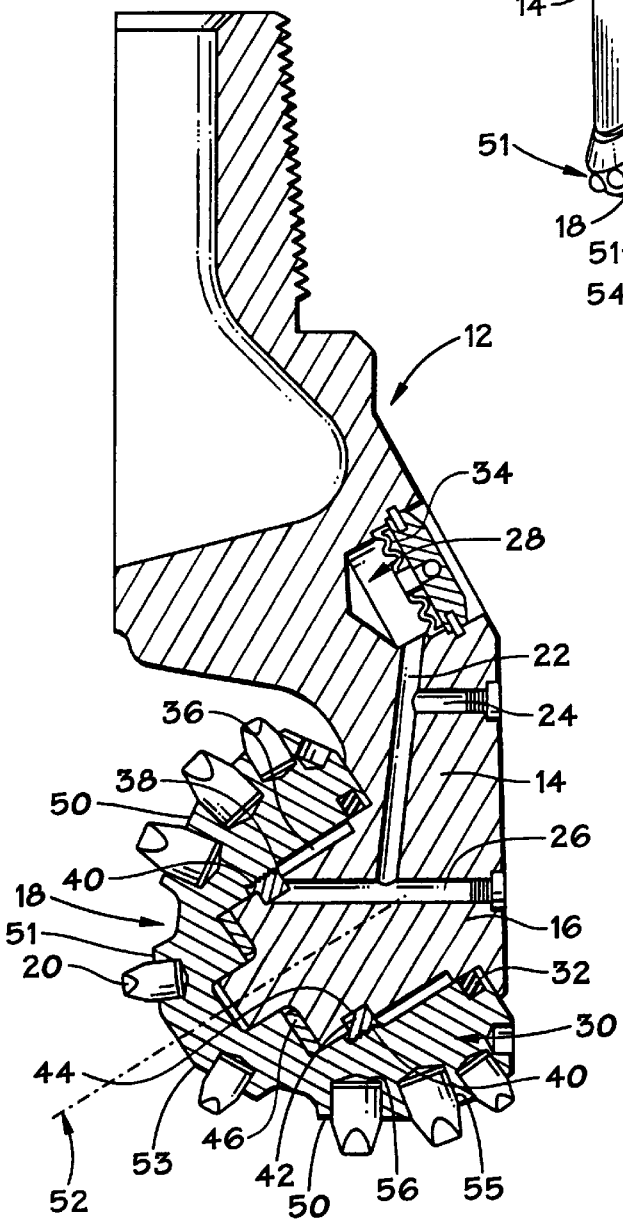
FIG. 2 is a partial cross-sectional view of a portion of the rolling cutter drill bit of FIG. 1.

With reference to FIGS. 1 and 2, a rolling cutter drill bit 10 is shown to include a body 12 (portions of which are not shown). The body 12 of a typical rolling cutter drill bit comprises three similar leg portions 14 (only two being shown in FIG. 1). A cantilevered bearing spindle 16 formed on each leg 14 extends inwardly and downwardly. A rolling cutter 18 is rotatably mounted upon the spindle 16, as hereinafter explained. Attached to the rolling cutter 18 are cutting inserts 20 which engage the earth to effect a drilling action and cause rotation of the rolling cutter 18. Typically, each cutting insert 20 will be formed of a hard, wear resistant material. Internal passageways 22, 24, & 26, as well as a reservoir 28 and the bearing area 30 of the leg 14, are filled with lubricant (not shown) during bit assembly. The lubricant helps reduce bearing friction and wear during bit operation and is retained within the cutter 18 by a dynamic seal 32. Pressure differentials between the lubricant and the external environment of the bit are equalized by the movement of a pressure balancing diaphragm 34.

The rolling cutter 18 is mounted upon the cantilevered bearing spindle 16 formed on the leg 14. A sliding bearing member, or bearing, 36 is mounted between the spindle 16 and a mating bearing cavity 38 formed in the cutter 18. This bearing 36 is designed to carry the radial loads imposed upon the cutter 18 during drilling. A second bearing member 42 is configured as a split threaded ring which engages internal threads 40 in the bearing cavity 38 of the cutter. This second bearing, or retention bearing, member 42 serves to retain the cutter 18 upon the bearing spindle by resisting the forces which tend to push the cutter 18 inward during drilling. A third bearing member 46 is disposed between the bearing spindle 16 and the cutter 18 to carry the axial loads between the cutter 18 and the spindle 16.

Figure 3:
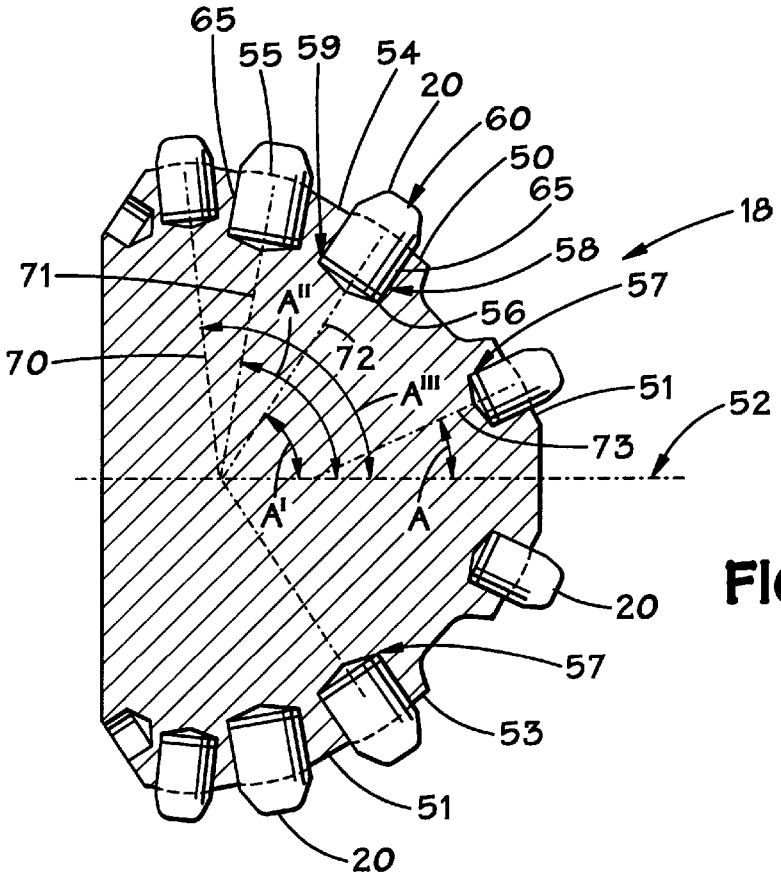
FIG. 3 is a schematic rolling cutter profile corresponding to the rolling cutter illustrated in FIG. 2.

With reference to FIGS. 1–4, each rolling cutter 18 has its outer surface 50 machined to form one or more conic segments, or conic bands, 51 having different conic angles, A, A', A", A'" (FIG. 3), bands 51 being disposed concentric with the longitudinal axis 52 of each cutter 18. The cutting inserts 20 may be arranged in rows disposed in the bands 51, as will be hereinafter described in greater detail. Although the bands 51 are curved, when viewed from the perspective of FIG. 4, the bands 51 are flat when viewed in a cross-section parallel to the longitudinal axis 52 of cutter 18, as is shown in FIG. 3. For clarity in understanding the present invention, the flat cross-section, or the upper surface, of a band 51 is defined as the axial surface 53 of a band 51. When describing the interaction of a cutting insert 20 and a band 51, the region of band 51 adjacent and surrounding the cutting insert 20 is referred to as a cutting insert pad 54.

Figure 4:
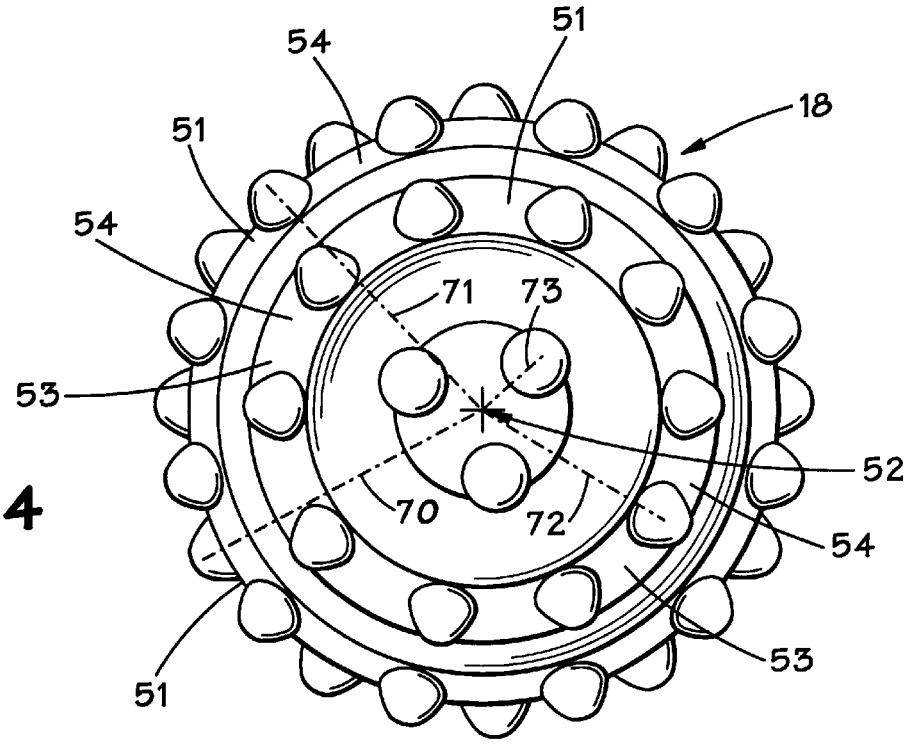
FIG. 4 is an end view of a rolling cutter as illustrated in FIGS. 1–3 taken along its longitudinal axis.
Figure 5:
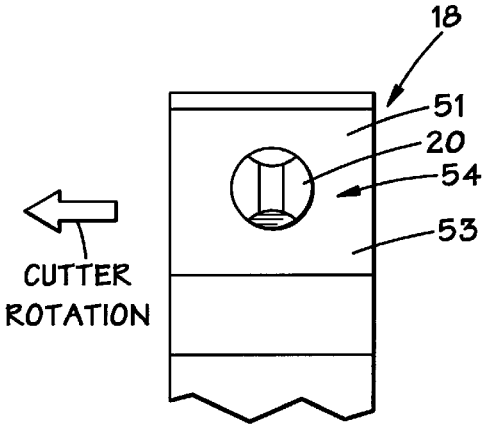
FIG. 5 (PRIOR ART)
FIG. 5 is a top view of a portion of a prior art rolling cutter.

Still with reference to FIGS. 1–4, each cutting insert 20 has an outer wall surface 55 and a bottom surface 56, the bottom surface 56 having a periphery 57. Preferably, cutting inserts 20 have a generally cylindrical shape, particularly at their lower ends 58, whereby periphery 57 has a substantially round, circular configuration. The lower end 58 of each cutting insert 20 is flat, although they could have other shapes on the bottom surface 56. As shown in FIG. 3, the outer wall surface 55 of each cutting insert 20 has a slight bevel, or chamfer 59 formed toward the lower end of each cutting insert. A plurality of sockets 65 are formed in the cutters 18 to receive the cutting inserts 20. Sockets 65 have a cross-sectional configuration which typically mates with the circular cross-sectional configuration of the cutting inserts 18. As is known in the art, the diameter of each socket 65 is slightly smaller than the diameter of the cutting insert to be received within its mating socket 65, whereby upon pressing, or inserting, each cutting insert 20 into its respective socket, or insert hole, 65, the cutting insert 20 will be retained within the socket 65 by an interference fit. The upper end 60 of each cutting insert 20 can have a variety of different shapes and be formed of a variety of different materials, as is known in the art. With reference to FIGS. 3 and 4, it is seen that the longitudinal axes 70–73 of each socket, or insert hole, 65 will intersect the longitudinal axis 52 of rolling cutter 18.

Turning now to FIGS. 5–9, the problem which the present invention solves is illustrated in FIGS. 5–9, in which a curved cutting insert pad 54, or conic band 51, is illustrated. Since cutting insert pad 54 is disposed on the outer, curved surface 50 of cutter 18, cutting insert pad 54 is similarly curved. As previously described, axial surface 53 appears flat as shown by the cross-section denoted 75 in FIG. 9. For illustrative purposes only, the radius of curvature of the cutting insert pad 54, or conic band 51, is exaggerated in FIGS. 6–8.

Figure 6:
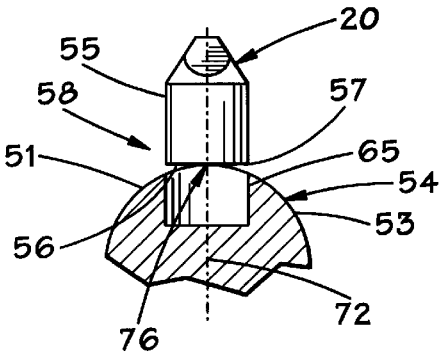
FIG. 6 (PRIOR ART)

As seen in FIG. 6, when cutting insert 20 is first disposed adjacent its mating socket 65, prior to being inserted, or pressed into, socket 65, the lower end 58 of cutting insert 20 is brought into contact with the axial surface 53 of the cutting insert pad 54. When cutting insert 20 is first brought into contact with the axial surface 53 of the cutting insert pad 54, the lower end 58, or periphery 57 of cutting insert 20 only contacts the axial surface 53 of cutting insert pad 54, at two points, the front point 76 being illustrated in FIG. 6, and both points 76, and 77 being best illustrated with reference to FIG. 9.

Figure 9:
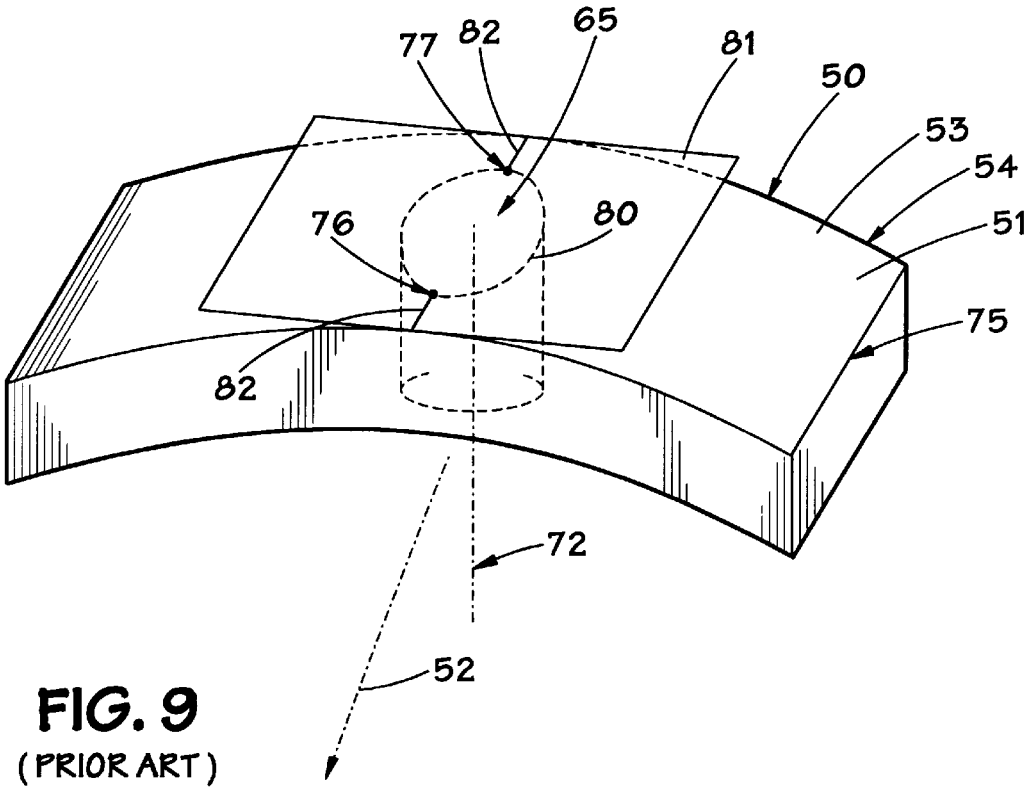
FIG. 9 (PRIOR ART)
FIG. 9 is a perspective view of a portion of a prior art rolling cutter, similar to those shown in FIGS. 6–8.

As seen in FIG. 9, socket 65 forms a juncture 80 with the axial surface 53 of cutting insert pad 54, or conic band 51. When a plane, or flat planar surface, 81 is brought into contact with axial surface 53 of the cutting insert pad 54, adjacent juncture 80, plane 81 only makes contact with axial surface 53 along a line 82. The line 82 only contacts juncture 80 at two points, 76, 77. If plane, or flat planar surface, 81 is considered to be representative of the lower end 58 of cutting insert 20, as illustrated in FIG. 6, the lower end 58, or periphery 57 of the bottom surface 56 of cutting insert 20, only contacts juncture 80 at the two points 76 and 77 on juncture 80. As seen in FIG. 6, the foregoing described two point contact, can result in the insert 20 initially being in an unstable state, whereby the cutting insert 20 can rock, or rotate, from side to side about the two contact points 76, 77, as illustrated in FIG. 9. If the equipment used to press cutting insert 20 into its socket 65 were perfectly aligned and had zero sliding clearances, the cutting insert 20 could be kept in perfect alignment. Although manufacturers attempt to precisely align the cutting insert 20 with its socket 65 prior to pressing into socket 65, it is extremely difficult to achieve that result for the following reasons.

Sliding clearances must exist in order for the pressing equipment and its associated fixtures to operate. The equipment must flex due to the high loads required to overcome sliding friction between the cutting insert 20 and its socket 65, as well as to overcome slight misalignments.

Figure 7:
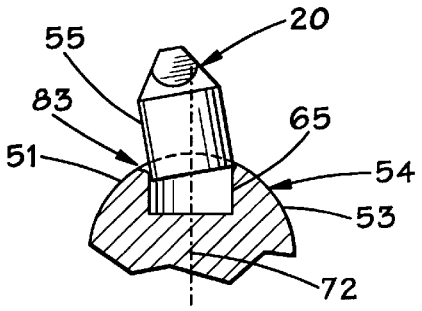
FIG. 7 (PRIOR ART)
FIGS. 6–8 are simplified side views of the structure shown in FIG. 5, illustrating the prior art installation sequence for a cutting insert into a socket.
Figure 8:
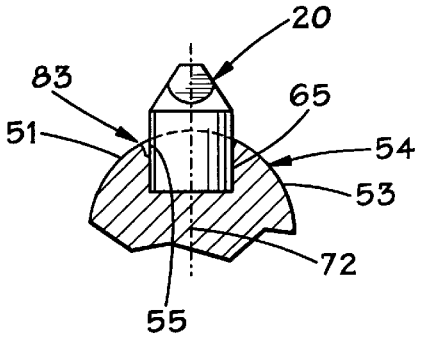
FIG. 8 (PRIOR ART)

With reference to FIGS. 7 and 8, the initial misalignment of cutting insert 20 with respect to socket 65,l as cutting insert 20 is first inserted into socket 65, can cause a deformation 83 in the axial surface 53 adjacent socket 65. The deformation 83 can occur because conventional hardened tungsten carbide cutting inserts 20 are generally harder than the steel material which forms cutting insert pad 54. As the cutting insert 20 is further inserted into its mating socket 65 to its final position as illustrated in FIG. 8, cutting insert 20 typically assumes its correct alignment with its longitudinal axis coinciding with the longitudinal axis of the socket, or insert hole, 65. The deformation 83 can permit abrasive particles (not shown) entering, and getting between, the outer wall surface 55 of cutting insert 20 and the inner wall surface of socket 65, during operation of the rolling cutter drill bit. As the cutting insert 20 is subjected to force loading and unloading during the drilling operation, the abrasive particles may abrasively wear upon the interior wall surface of socket 65, which in turn may reduce the strength of the interference fit between the cutting insert 20 and its mating socket 65.

Figure 10:
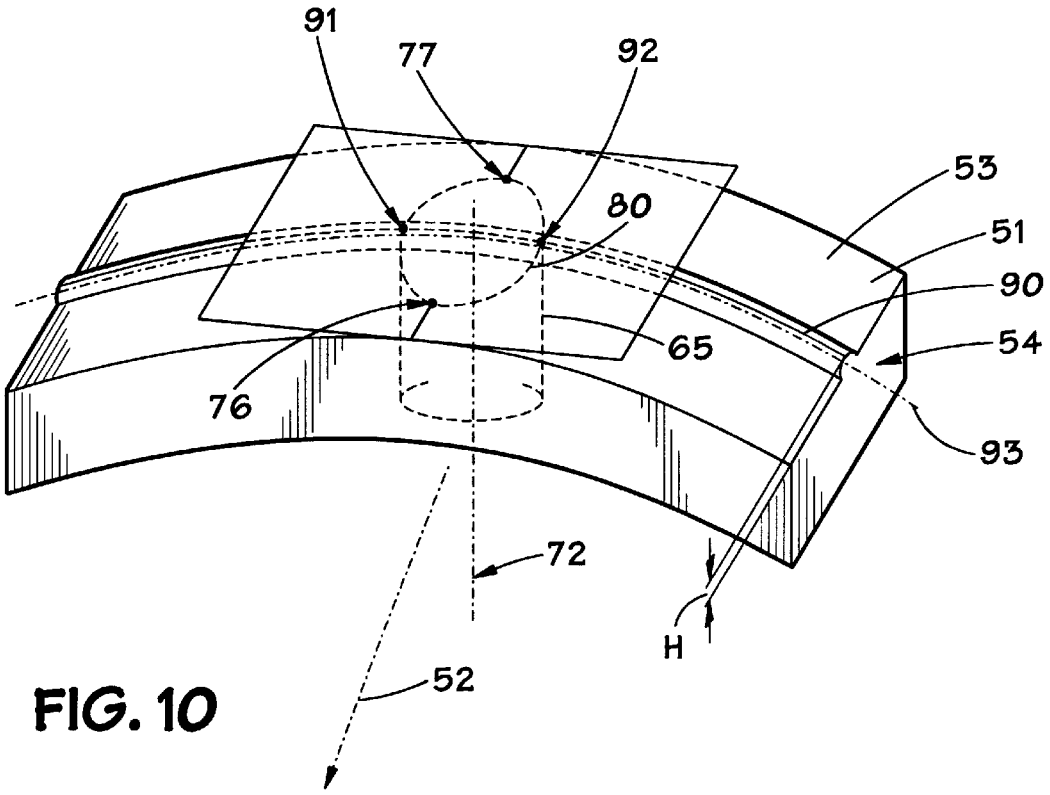
FIG. 10 is a perspective view of a portion of a rolling cutter made in accordance with the present invention.
Figure 11:
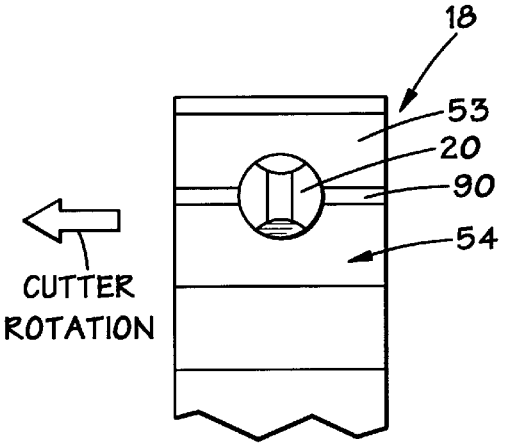
FIG. 11 is a top view of a portion of a rolling cutter, in accordance with the present invention.

With reference to FIGS. 10 and 11–14, one embodiment of the present invention will be described. A conventional cutting insert pad 54 for a rolling cutter 18 having an axial surface 53 may be provided with an upwardly extending ridge 90 disposed upon the axial surface 53. Ridge 90 may extend the length of the cutting insert pad 54, or conic band 51, as illustrated in FIG. 10, or it may be only disposed adjacent socket 65, and adjacent juncture 80 between socket 65 and the axial surface 53. Preferably, the portion of ridge 90 disposed adjacent to juncture 80 contacts, and forms a part of, juncture 80. As illustrated in FIG. 10, after socket 65 has been drilled into cutting insert pad 54, or conic band 51, the remaining portion of ridge 90 adjacent juncture 80, will contact juncture 80 at two points 91, 92. As shown in FIG. 10, when a plane, or flat planar surface, 81 such as the lower end 58 of cutting insert 20, or its periphery 57 around the bottom surface 56 of cutting insert 20, is brought into contact with juncture 80, the plane 81, or periphery 57 of cutting insert 20, will contact juncture 80 in at least three points, 76, 77, and 91, or 76, 77, and 92. As illustrated in FIG. 10, plane 81 or the periphery 57 of cutting insert 20, would contact juncture 80 at four points, 76, 77, 91, and 92. In this regard, if only a portion of ridge 90 is disposed adjacent only one side of juncture 80, such as illustrated at point 91, and the other side, or right side as viewed in FIG. 10, of axial surface 53 adjacent juncture 80 is not provided with ridge 90, but remains flat, plane 81, or the periphery 57 of cutting insert 20, would only contact juncture 80 at the three points 76, 77, and 91.

Figure 13:
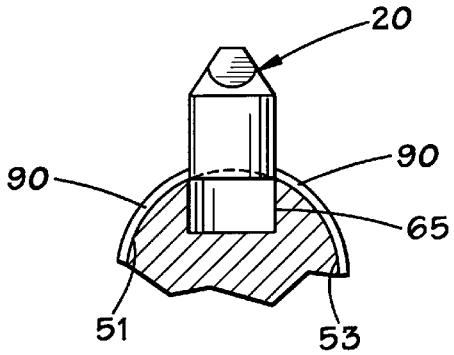
FIGS. 12–14 are simplified side views of the structure, shown in FIG. 11, illustrating a cutting insert installation procedure, in accordance with the present invention.
Figure 12:
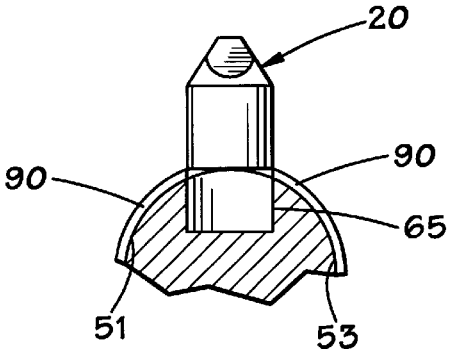
Figure 14:
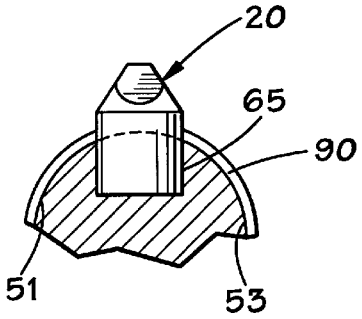

Further, if plane 81, or periphery 57 of cutting insert 20, makes contact with juncture 80 in at least three points, cutting insert 20 will be properly stabilized prior to being pressed into its mating socket 65, without the undesired rocking, or rotating about points 76, 77, as shown in FIGS. 12–14.

Although upwardly extending ridge 90 is illustrated having a rounded configuration, other configurations could be utilized for upwardly extending ridge 90 such as square, rectangular, triangular, or other polygonal configurations, all of which would provide at least one additional point of contact at, or adjacent, juncture 80 of socket 65 with the periphery 57 of cutting insert 20 or a plane 81 as illustrated in FIG. 10. Ridge 90 may be formed integral with clutter 18 as by machining ridge 90 onto the axial surface 53 when the conic bands 51 are formed. Alternatively, upwardly extending ridge 90 could be secured in its desired location adjacent to juncture 80 as by welding, or by use of a suitable epoxy. Although ridge 90 is shown disposed substantially parallel with the longitudinal axis 93 of the cutting insert pad 54, or perpendicular to the longitudinal axis 52 of cutter 18, ridge 90 could be angularly disposed with respect to the longitudinal axis 93 of cutting insert pad 54, or could also have a serpentine shape.

With reference to FIG. 15, another embodiment of the present invention is illustrated. The same reference numerals are used for elements which are identical to those previously described, and primed reference numerals are used for elements similar in design, construction, and operation to those previously described. A cutting insert pad 54', or conic band 51', having an axial surface 53', has a socket 65 formed therein for receiving a cutting insert 20. Instead of axial surface 53 of cutting insert pad 54, or conic band 51 being flat, as illustrated in FIGS. 9 and 10, axial surface 53' has a spherically shaped axial surface 53' as indicated at 75'. Axial surface 53' of cutting insert pad 54', or conic band 51', may also have a convex shape. When a plane, or flat planar surface, 81 perpendicular to the longitudinal axis 72' of socket 80' is brought into contact with the juncture 80' between socket 65 and axial surface 53', the plane will contact the entire juncture 80', as well as make contact with the plane 81 along line 82. Accordingly, when the periphery 57 of a cutting insert 20 is initially brought into contact with juncture 80', the periphery 57 of cutting insert 20 will contact, and be stabilized by, the entire juncture 80', which is contact with the juncture 80' in at least three points located on the juncture 80'. The axial surface 53' of cutting insert pad 54', or conic band 51' may be readily formed when axial surface 53' of the cutting insert pad 54' on cutter 18 is machined.

With reference to FIGS. 15 and 16, the radius of curvature R for the spherical shaped axial surface 53' may be determined in the following manner. In FIG. 16, a socket 65 is illustrated corresponding to the socket 65 of FIG. 3 having longitudinal axis 72, disposed with respect to the longitudinal axis 52 of cutter 18. Socket 65 has a diameter D which has a radius equal to ½ D. The top surface 95 of socket 65 is disposed perpendicular to the longitudinal axis 72 of socket 65, and the longitudinal axis 72 of socket 65 intersects the longitudinal axis 52 of cutter 18, as previously described. The distance measured from the point of intersection of axis 72 with cutter axis 52 to the upper surface 95 of socket 65 is designated as S, as shown in FIG. 16. The minimum radius of curvature R for the axial surface 53' of cutting insert pad 54' to achieve the desired stabilization of cutting insert 20 may be determined in accordance with the following formula:

$$R = \sqrt{S^2 + \left(\frac{1}{2}D\right)^2}$$

The difference between the length of the radius of curvature R and the distance S is denoted as G in FIG. 16 which indicates the gap, or difference, between the radius of curvature R and the distance S in order for plane 81 to contact the axial surface 53' of cutting insert pad 54' in the manner illustrated in FIG. 15. If the embodiment of the present invention in accordance with FIG. 10 is utilized, the gap G determined in accordance with the foregoing determination and formula, is equal to the minimum vertical height H of upstanding ridge 90 of FIG. 10 as measured from the flat upper surface 53 of FIG. 10. It should readily apparent to one of ordinary skill in the art that the size of the gap G is the maximum value for the vertical height H, and the calculated radius R is the minimum value for the radius of curvature of surface 75' in order for the embodiments of the present invention of FIGS. 10 and 15 to function in the desired manner. It is thus seen that the height H of ridge 90 and the radius of curvature R are a function of the diameter D of socket 65, and the distance S along the longitudinal axis 72 of socket 65 to the longitudinal axis 52 of cutter 18.

Figure 17:
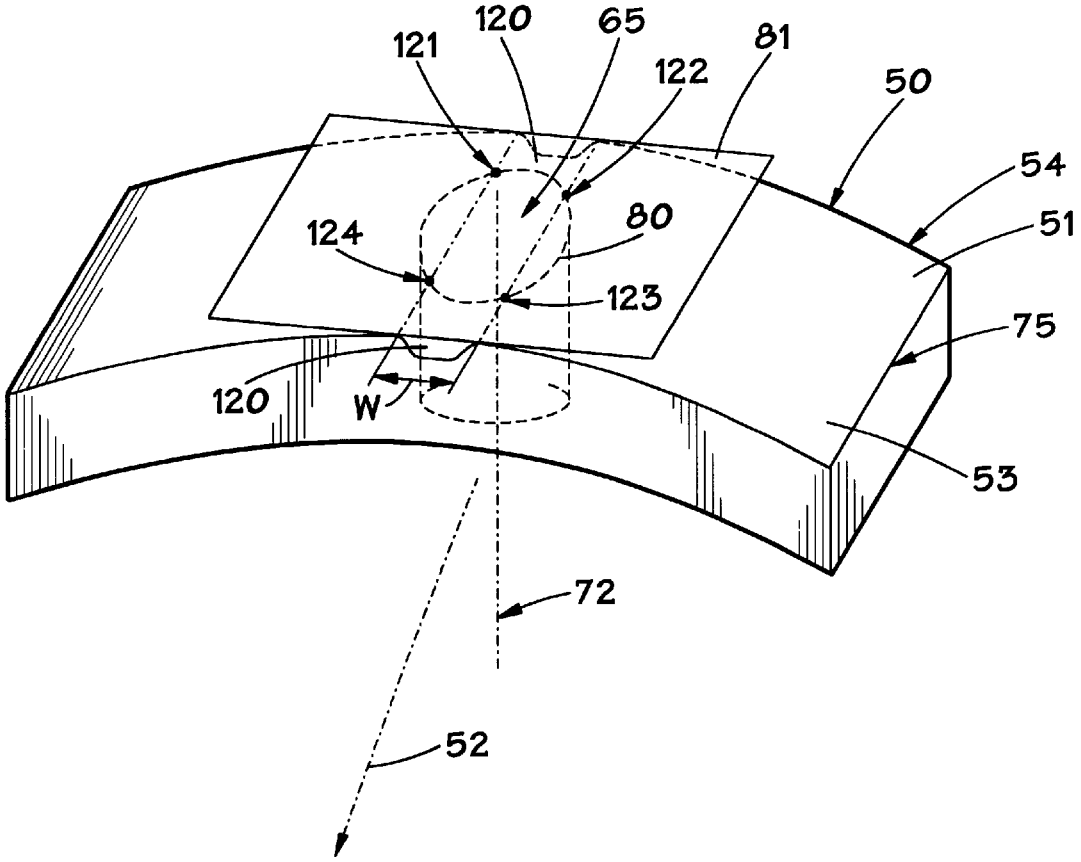
FIG. 17 is a perspective view of a portion of a rolling cutter in accordance with another embodiment of the present invention.

Turning now to FIG. 17, another embodiment of the present invention will be described. A conventional cutting insert pad 54, or conic band 51, for rolling cutter 18 having an axial surface 53 may be provided with a downwardly extending groove 120 disposed in cutting insert pad 54, or conic band 51, groove 120 lying in a plane beneath axial surface 53. Groove 120 is disposed parallel with the longitudinal axis 52 of cutter 18. The length of groove 120 formed in axial surface 53 may be any length, provided, a portion of groove 120 is disposed adjacent socket 65, and adjacent juncture 80 between socket 65 and the axial surface 53. Preferably, the portion of groove 120 disposed adjacent to juncture 80 contacts, and forms a part of juncture 80. The groove 120 may have any desired width W and any desired depth, provided groove 120 functions in the manner to be hereinafter described. As illustrated in FIG. 17, after socket 65 has been drilled into cutting insert pad 54, or conic band 51, when a plane, or flat planar surface, 81, such as the lower end 58 of cutting insert 20, or its periphery 57 around the bottom surface 56 of cutting insert 20, is brought into contact with juncture 80, the plane 81, or periphery 57 of cutting insert 20, will contact juncture 80 in at least four points, 121–124. Provided plane 81, or periphery 57 of cutting insert 20, makes contact with juncture 80, in at least three points, four points being illustrated in FIG. 17, cutting insert 20 will be properly stabilized prior to being pressed into it mating socket 65, without the undesired rocking, or rotating about points 76, 77, as shown in FIGS. 12–14. Groove 120 may be formed in any conventional manner, including machining groove 120 at the time conic band 51 is machined, or after conic band 51 is machined.

By utilizing the present invention, stabilized cutting insert holes, or sockets, may be provided without an additional, undesired, spotfacing step. Additionally, it has been determined that distortion of the socket during use of the drill bit is reduced due to an increase of stability of the cutting insert during its insertion into its mating socket. It has also been determined that the amount of retention force caused by the interference fit between the cutting insert 20 and socket 65 is increased, which is a desirable advantage over prior art designs.

It is to be understood that the invention is not limited to the exact details of construction, operation, exact materials, or embodiments shown and described, as obvious modifications and equivalents will be apparent to one skilled in the art. For example, the cutting inserts could have other cross-sectional configuration other than the circular cross-sectional configuration illustrated in connection with the preferred embodiment. Accordingly, the invention is therefore to be limited only by the scope of the appended claims.

What is claimed is:

1. A rolling cutter drill bit, comprising:

a body;

at least one leg;

a bearing spindle formed on the at least one leg;

a rolling cutter, having an outer surface, rotatably mounted upon the bearing spindle;

at least one conic band disposed upon the outer surface of the rolling cutter;

at least one socket formed in the at least one conic band;

at least one cutting insert received within the at least one socket, the at least one cutting insert having an outer wall surface and a bottom surface, the bottom surface having a periphery, the outer surface of the at least one cutting insert being received within the at least one socket with an interference fit; and the at least one socket forming a juncture with the at least one conic band, the juncture contacting a plane in contact with the juncture in at least three points located on the juncture.

2. The rolling cutter of claim 1, wherein when the at least one cutting insert is first inserted into the at least one socket, the periphery of the bottom surface of the at least one cutting insert contacts the juncture of the at least one socket in at least three points located on the juncture.

3. The rolling cutter of claim 1, wherein the at least one conic band has a spherically shaped axial surface.

4. The rolling cutter of claim 1, wherein the at least one conic band has a convex shaped axial surface.

5. The rolling cutter of claim 1, wherein the at least one conic band has an axial surface, and further includes an upwardly extending ridge disposed upon the axial surface, with the juncture, of the at least one socket with the at least one conic band, including at least one portion of the upwardly extending ridge.

6. The rolling cutter of claim 1, wherein the at least one conic band has an axial surface, and further includes a downwardly extending groove formed in the axial surface with the juncture, of the at least one socket with the at least one conic band, including at least one portion of the downwardly extending groove.

7. The rolling cutter of claim 1, wherein the plane is disposed substantially perpendicular to the socket.

8. A method for making a rolling cutter drill bit, which includes at least one rotatably mounted rolling cutter having an outer surface, and at least one conic band disposed upon the outer surface of the rolling cutter comprising the steps of:

forming at least one socket in the at least one conic band of the rolling cutter, at least one socket forming a juncture with the at least one conic band;

providing at least one cutting insert having an outer wall surface and a bottom surface, the bottom surface having a periphery, the at least one cutting insert being sized to be received within the at least one socket with an interference fit;

inserting the at least one cutting insert into the at least one socket by first bringing the periphery of the bottom surface of the cutting insert into contact with at least three points located on the juncture to stabilize the at least one cutting insert with respect to the at least one socket; and thereafter pressing the at least one cutting insert into the at least one socket, until the at least one cutting insert is retained in the at least one socket by an interference fit.

9. The method of claim 8, wherein the at least one conic band has an axial surface, including the step of providing the axial surface with a spherical shape.

10. The method of claim 8, wherein the at least one conic band has an axial surface, including the step of providing the axial surface with a convex shape.

11. The method of claim 8, wherein the at least one conic band has an axial surface, and including the step of providing an upwardly extending ridge upon the axial surface with the juncture, of the at least one socket with the at least one conic band, including at least one portion of the upwardly extending ridge.

12. The method of claim 8, wherein the at least one conic band has an axial surface, and including the step of providing a downwardly extending grove in the axial surface, with the juncture, of the at least one socket with the at least one conic band, including at least one portion of the downwardly extending groove.

13. A rolling cutter drill bit, comprising:

a body;

at least one leg;

a bearing spindle formed on the at least one leg;

a rolling cutter, having an outer surface and a longitudinal axis, rotatably mounted upon the bearing spindle;

at least one conic band disposed upon the outer surface of the rolling cutter;

at least one socket, having a longitudinal axis, formed in the at least one conic band, the at least one socket having a diameter D;

the at least one socket having an upper surface, disposed perpendicular to the longitudinal axis of the socket, and the distance between the upper surface of the at least one socket and the intersection of the longitudinal axis of the at least one socket with the longitudinal axis of the rolling cutter is S;

at least one cutting insert received within the at least one socket, the at least one cutting insert having an outer wall surface and a bottom surface, the bottom surface having a periphery, the outer surface of the at least one cutting insert being received within the at least one socket with an interference fit; and the at least one conic band having a convex axial surface, with a minimum radius of curvature R, wherein R is determined in accordance with the formula:

$$R = \sqrt{S^2 + \left(\frac{1}{2}D\right)^2}.$$

14. A rolling cutter drill bit, comprising:

a body;

at least one leg;

a bearing spindle formed on the at least one leg;

a rolling cutter, having an outer surface and a longitudinal axis, rotatably mounted upon the bearing spindle;

at least one conic band disposed upon the outer surface of the rolling cutter;

at least one socket, having a longitudinal axis, formed in the at least one conic band, the at least one socket having a diameter D;

the at least one socket having an upper surface, disposed perpendicular to the longitudinal axis of the socket, and the distance between the upper surface of the at least one socket and the intersection of the longitudinal axis of the at least one socket with the longitudinal axis of the rolling cutter is S;

at least one cutting insert received within the at least one socket, the at least one cutting insert having an outer wall surface and a bottom surface, the bottom surface having a periphery, the outer surface of the at least one cutting insert being received within the at least one socket with an interference fit;

the at least one conic band having an axial surface and an upwardly extending ridge, having an upper surface, disposed upon the axial surface, the ridge having a maximum height H, and the distance between the upper surface of the ridge and the intersection of the longitudinal axis of the at least one socket with the longitudinal axis of the rolling cutter is R, wherein R is determined in accordance with the formula:

$$R = \sqrt{S^2 + \left(\frac{1}{2}D\right)^2}\text{; and}$$

the maximum height H of the ridge is equal to R-S.

* * * * *